US007326079B2

(12) United States Patent
Holliday et al.

(10) Patent No.: US 7,326,079 B2
(45) Date of Patent: Feb. 5, 2008

(54) MINI-COAXIAL CABLE SPLICE CONNECTOR ASSEMBLIES AND WALL MOUNT INSTALLATION TOOL THEREFOR

(75) Inventors: Randall A. Holliday, Broomfield, CO (US); Robert M. Parker, Aurora, CO (US); Ronald S. Munsterman, Arvada, CO (US)

(73) Assignee: RHPS Ventures, LLC, Denver, CO (US)

( * ) Notice: Subject to any disclaimer, the term of this patent is extended or adjusted under 35 U.S.C. 154(b) by 0 days.

(21) Appl. No.: 11/408,479

(22) Filed: Apr. 21, 2006

(65) Prior Publication Data

US 2006/0189188 A1 Aug. 24, 2006

Related U.S. Application Data

(63) Continuation-in-part of application No. 10/885,246, filed on Jul. 6, 2004, now Pat. No. 7,059,900, and a continuation-in-part of application No. 11/111,198, filed on Apr. 20, 2005, now Pat. No. 7,156,695.

(51) Int. Cl.
*H01R 9/05* (2006.01)

(52) U.S. Cl. ..... 439/578; 439/584

(58) Field of Classification Search ..... 439/578, 439/584, 585

See application file for complete search history.

(56) References Cited

U.S. PATENT DOCUMENTS

| | | | | |
|---|---|---|---|---|
| 3,601,524 | A | | 8/1971 | Kauffman |
| 4,280,748 | A | | 7/1981 | McHenney et al. |
| 4,932,897 | A | | 6/1990 | Lee et al. |
| 5,232,377 | A | | 8/1993 | Leibfried, Jr. |
| 5,392,508 | A | | 2/1995 | Holliday et al. |
| 5,480,325 | A | | 1/1996 | Tran et al. |
| 5,529,513 | A | | 6/1996 | Lee |
| 5,548,088 | A | | 8/1996 | Gray et al. |
| 5,596,800 | A | | 1/1997 | Holliday |
| 5,641,306 | A | | 6/1997 | Sterniak |
| 5,651,698 | A | | 7/1997 | Locati et al. |
| 5,769,662 | A | | 6/1998 | Stabile et al. |
| 5,863,220 | A | * | 1/1999 | Holliday ..... 439/584 |
| 5,938,465 | A | | 8/1999 | Fox, Sr. |
| 6,027,373 | A | | 2/2000 | Gray et al. |
| 6,146,197 | A | | 11/2000 | Holliday |
| 6,153,830 | A | | 11/2000 | Montena |
| 6,159,046 | A | | 12/2000 | Wong |
| 6,179,656 | B1 | | 1/2001 | Wong |
| 6,352,448 | B1 | | 3/2002 | Holliday et al. |
| 6,406,330 | B2 | | 6/2002 | Bruce |
| 6,517,379 | B2 | | 2/2003 | Leve |
| 6,551,127 | B1 | | 4/2003 | Li et al. |

(Continued)

*Primary Examiner*—Michael C. Zarroli
(74) *Attorney, Agent, or Firm*—John E. Reilly; The Reilly Intellectual Property Law Firm, P.C.

(57) ABSTRACT

A splice connector assembly for electrically connecting or splicing mini-coaxial cable ends together includes an insert having opposed conductor pin-receiving sockets, a crimping member at one end of the body for crimping one cable end to the body with its conductor pin inserted into one of the sockets, and another cable end having its conductor pin inserted into the other socket, the assembly being conformable for use alone or in wall mount applications and with a wall mount clip color-coded to signify intended application of the splice connector for different uses and a tool for positioning the clip onto the connector body.

29 Claims, 7 Drawing Sheets

U.S. PATENT DOCUMENTS 6,708,396 B2 3/2004 Holliday
6,805,583 B2 10/2004 Holliday et al.
6,935,892 B2 8/2005 Holliday
2003/0181099 A1* 9/2003 D'Addario ..... 439/578

* cited by examiner

MINI-COAXIAL CABLE SPLICE CONNECTOR ASSEMBLIES AND WALL MOUNT INSTALLATION TOOL THEREFOR

CROSS-REFERENCE TO RELATED APPLICATIONS

This application is a continuation-in-part patent application of Ser. No. 10/885,246, filed Jul. 6, 2004 for COAXIAL CABLE SPLICE CONNECTOR ASSEMBLIES by Randall A. Holliday, now U.S Pat. No. 7,059,900, and of Ser. No. 11/111,198, filed Apr. 20, 2005 now U.S. Pat. No. 7,159,695 for ADAPTER FOR COAXIAL CABLE WITH INTERCHANGEABLE COLOR BANDS by Randall A. Holliday, now U.S. Pat. No 7,156,695, and both incorporated by reference herein.

BACKGROUND

This invention relates to coaxial cable connectors; and more particularly relates to splice connectors for splicing the ends of coaxial cables together.

In coaxial cable installations, it is often necessary to splice the ends of two cables together. In the past, this has been done by exposing the conductor portions at the end of each cable and attaching special connectors to each end; and the special connectors in turn are then interconnected to opposite ends of a common connector body in such a way as to establish an electrical connection therebetween. Accordingly, there is presently an unmet need for a splice connector which will eliminate special end connectors on the end of each cable as well as to achieve a highly secure connection with minimal signal loss. This is of importance in home entertainment systems in creating improved connections or splicing between mini-coaxial cables as well as wall connections for the min-coaxial cables either manually or with the aid of a tool of the type customarily employed for crimping of a connector to a cable.

SUMMARY

It is therefore an object to provide for a novel and improved splice connector for coaxial cable installations.

It is another object to provide for a splice connector which is adaptable for use in different applications to establish secure interconnection between ends of a pair of min-coaxial cables to be joined together while avoiding the use of threaded fasteners.

It is another object to provide for a novel and improved method and means for interchangeably connecting different colored bands to a coaxial cable splice connector according to its intended application.

It is a further object to provide for a novel and improved splice connector conformable for use in the interconnection of a pair of min-coaxial cables in various applications, such as, wall mounts and which eliminates parts as well as requires less space in the installation or assembly of the cable and connector into a wall.

It is still another object to provide for a novel and improved connector body incorporating a starter guide extension for a pin conductor to facilitate blind insertion of the cable into one end of the connector body so as to be precisely centered for insertion of another pin conductor at the end of a second coaxial cable and wherein the connector body is readily conformable for use with different types of RGB connectors including but not limited to BNC, RCA and F-connectors.

In one aspect, a splice connector has been devised for electrically connecting pin or wire-like connectors at ends of each of a pair of cables, the connector comprising a tubular connector body including an insert with a socket end portion in combination with an adapter sleeve therein for insertion of opposite ends of the cables, the adapter including an electrically conductive portion to receive one of the conductors, the guide being axially advanced into centered relation to the adapter, and another of the conductors being inserted into a recessed portion at the socket end of the insert.

In another embodiment, the splice connector includes a special wall mounting clamp which is snap-fit with a tool onto a non-circular external surface portion of the connector body prior to mounting in the wall of an electrical outlet box, and an opposite end of the connector body protrudes from the wall mounting clamp for connection of the second cable with a color ring mounted on the opposite end in accordance with a standard color code for the industry so as to be visible externally of the wall plate. Typically, the RGB connector body would be a BNC, RCA or F-type socket connector and the second cable would be terminated with a corresponding male connector end in which the conductor extends from the male connector for insertion into a recessed portion at the socket end of the insert.

In a further embodiment, a corresponding type of splice connector body is employed with a resilient band or ring on its external surface which is color-coded to signify the intended application of the splice connector. The band can be attached to the body after one cable is connected to one end of the insert and the insert is crimped into position in the connector body, after which a second cable is inserted into the opposite end of the splice connector body to complete the connection to the selected electronic component. The color-coded band or ring is manually stretchable over the connector body and releasable to contract into close-fitting engagement with a groove on the body, and in wall mounting applications the band or ring is mounted in a groove externally of the wall mount installation so that it is visible after the installation is completed.

The above and other objects, advantages and features of the embodiments described will become more readily appreciated and understood from a consideration of the following detailed description when taken together with the accompanying drawings in which:

DETAILED DESCRIPTION

FIGS. 1 to 22 illustrate embodiments of the present invention which are specifically adaptable for use with smaller diameter coaxial cables, customarily referred to as mini-coaxial cables which are on the order of 2.5 mm. to 4 mm. in diameter and are utilized with RGB splice connector bodies including but not limited to the BNC and RCA connector bodies.

Figure 10:
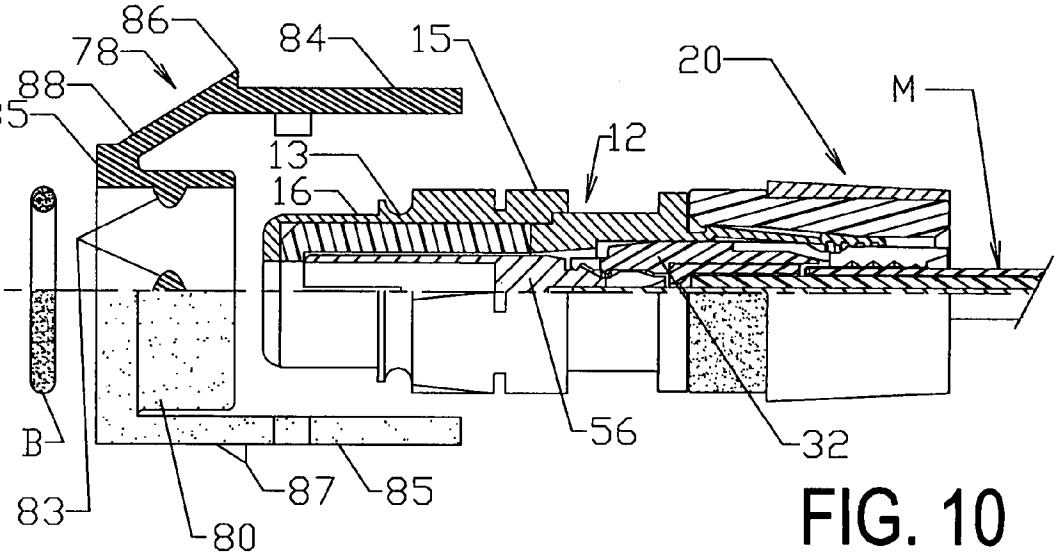
FIG. 10 is an exploded view in section of an RCA connector and a wall mount clip and color band.
Figure 12:
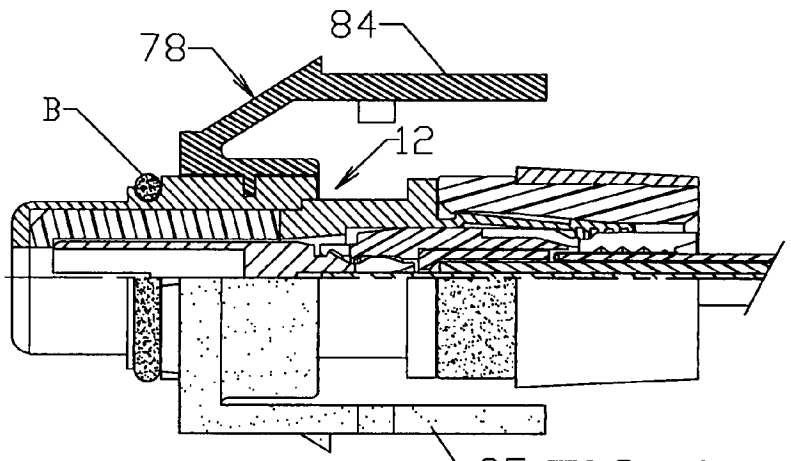
FIG. 12 is a view partially in section of the form shown in FIG. 10 after the clip and color band have been mounted thereon.
Figure 11:
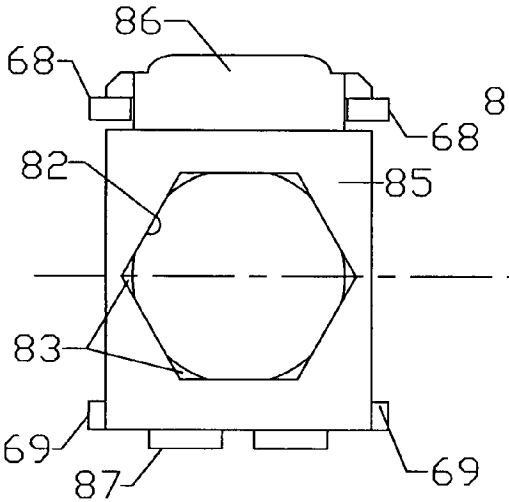
FIG. 11 is an end view of the clip shown in FIG. 10.

In FIGS. 1 to 5 a wall mount splice connection is comprised of an RCA socket-type connector 10 having a barrel portion 12 which is enlarged at one end to provide a hexagonal surface portion 15; and an external circumferentially extending groove 13 is provided which may, for example, accommodate a color band B shown in FIGS. 10 and 12 and selected from one of a set of different colored bands which are furnished for the installation. Each band B may be composed of an elastic material and sized to fit over the connector body and then released to contract into the groove 13. Thus, the user can identify the specific application after installing a given size and frequency of cable into the connector 10. A series of grooves or slots 14 are provided on the hexagonal portion 15 for insertion of a seal to be hereinafter described.

An inner concentric sleeve 16 is composed of an electrically non-conductive material and mounted within the barrel 12 to receive an insert 30, and the sleeve 16 extends from an end of the connector body 9 to a stop 10' at the end of the barrel 12. In addition, an external rib 11 is mounted on the barrel 9 for a purpose to be described; and the body 12 is in the form of a standard universal compression connector adapted to accommodate different sized cables and includes first and second tapered sleeves S1 and S2 in stepped relation to one another and interconnected to form a first external shoulder therebetween. The first sleeve S1 also forms an external shoulder at one end which terminates in a groove 17. The sleeve S2 is provided with inner sealing ribs 18, the sealing ribs 18 being axially spaced along the inner wall surface of the sleeve S2 to effect a positive sealed engagement with a cable member inserted therein.

A crimping ring 20 is preassembled over the sleeve S2 and is comprised of a main body 22 which is composed of a plastic material of limited compressibility, such as, DELRIN®. The leading end of the body 22 which fits over the sleeve S2 has an inner, tapered wall surface which terminates in an internal shoulder 24 at its leading end, the end 24 being of a diameter slightly less than the external diameter of the distal end of the sleeve S2 so that the shoulder 24 can be forced over the distal end until it extends beyond the sealing rings 18 and is then free to expand into engagement with the external surface of the sleeve S1. The body 22 is undercut along its outer surface to receive a reinforcing liner 25 which will fit snugly over the body 22 and limit expansion of the body 22 when it is subsequently advanced over the sleeve S2 during the crimping operation to be described.

Figure 7:
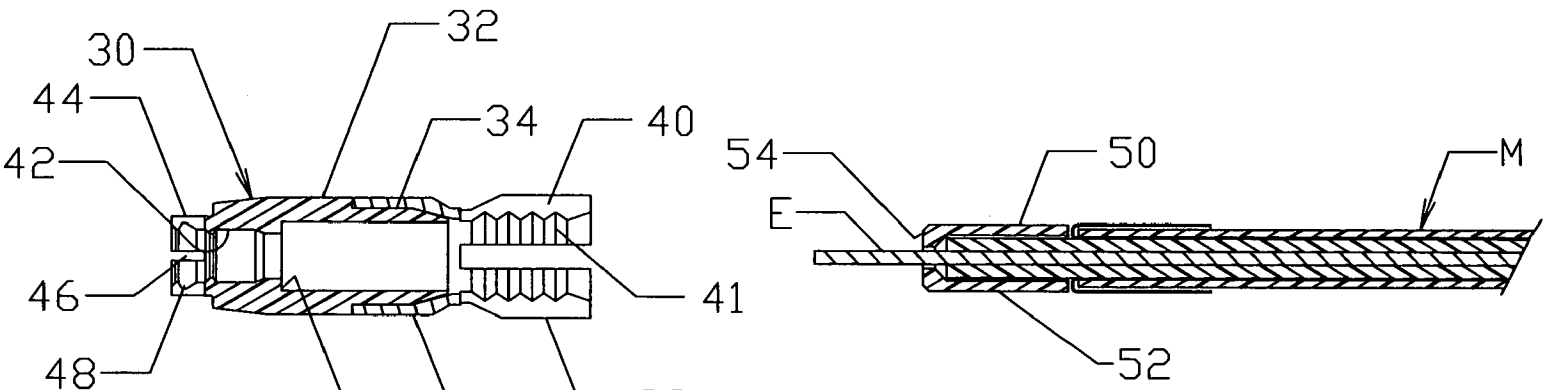
FIG. 7 is another exploded view of the assembled extension tip of FIG. 1 and an adapter sleeve.
Figure 8:
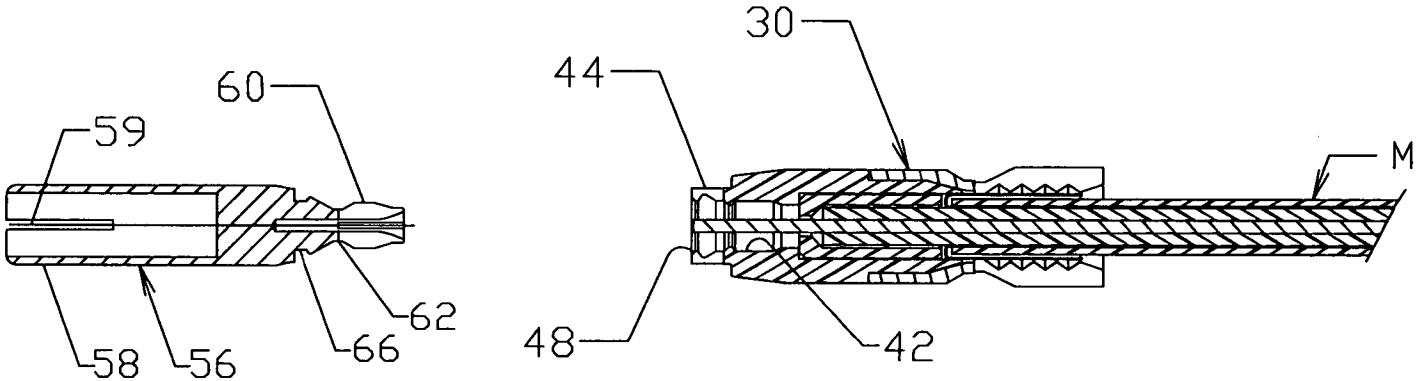
FIG. 8 is another exploded view of a socket end portion prior to assembly onto the adapter sleeve.
Figure 9:
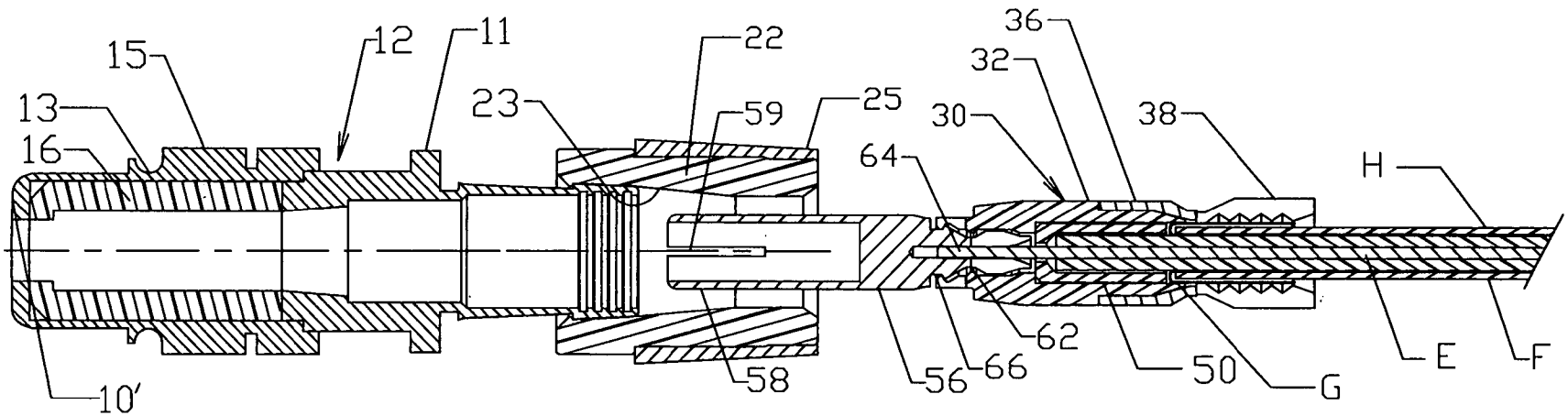
FIG. 9 is a view in section of one embodiment of FIGS. 1 to 5 illustrating the initial stages of assembly of a mini-coaxial cable in relation to the RCA connector.

In order to splice the exposed ends of a pair of mini-coaxial cables M and M' together, an insert 30 is shown in various stages of assembly in FIGS. 6 to 9 and is made up of an elongated tubular portion 32 of an electrically non-conductive material and which is undercut at one end 34 to receive the end of an adapter sleeve 36 of electrically conductive material. The sleeve 36 diverges into relatively thick arcuate end portions 38 which are separated by longitudinally extending slots 40 and have internal teeth 41 as illustrated in FIGS. 7 to 9 for the RCA connector version herein described. The opposite end of the tubular portion 32 has an inner wall surface 42 which diverges into a thin-walled annular end retainer 44. The retainer 44 is longitudinally slotted at circumferentially spaced intervals to form an internal bore 48. The tubular portion 32 receives a first socket end portion 50 which has a hollow, thin-walled cylindrical body 52 and which terminates in an annular end wall 54. The socket end portion 50 fits snugly within the tubular portion 32 with the end wall 54 abutting inner shoulder 33 as best seen from FIGS. 7, 8 and 9.

Referring to FIG. 9, the second socket end portion 56 includes a tubular end 58 provided with spaced longitudinal slots 59 and terminates in a nose 60 at an opposite end with longitudinal slots 62 dividing the end of the nose 60 into arcuate segments, and the hollow interior of the nose 60 communicates with a central bore 48. When the nose 60 is advanced into the bore 64, an external shoulder 66 on the nose will force the end retainer 44 to expand until the shoulder 66 moves into mating engagement with the end portion 46.

Each of the mini-coaxial cables M and M' is of standard construction and made up of a central conductor pin or wire E, a dielectric layer F, an outer braided conductive layer G, an insulating jacket H, and typically a foil layer is interposed between the layers G and H. The end of each cable M and M' is prepared by removing a limited length of the jacket H and an even shorter length of the dielectric F so as to expose the end of the conductor pin or wire E; and the conductive layer G is peeled away from the dielectric layer F and doubled over the end of the jacket H. The socket end portion 50 is dimensioned to fit snugly over the exposed dielectric layer G with the pin E extending through the central bore 48 and nose 60, as best seen from FIGS. 8 and 9.

Figure 1:
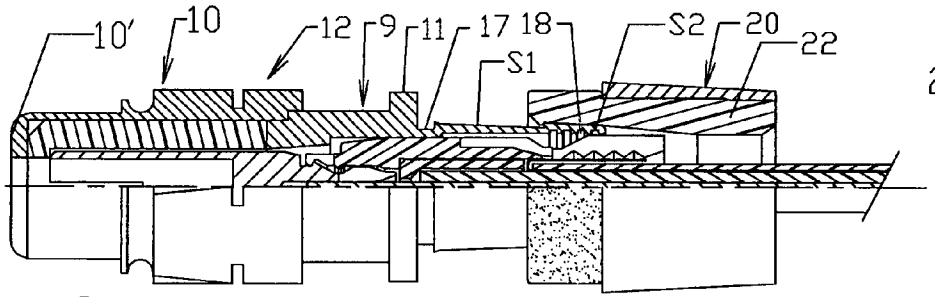
FIG. 1 is a view partially in section of an RCA connector assembly with a mini-cable inserted into the connector prior to the crimping operation.
Figure 2:
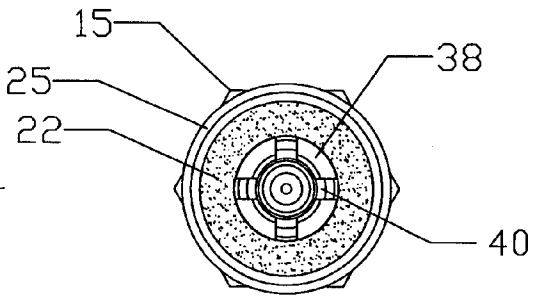
FIG. 2 is an end view of the assembly shown in FIG. 1.
Figure 3:
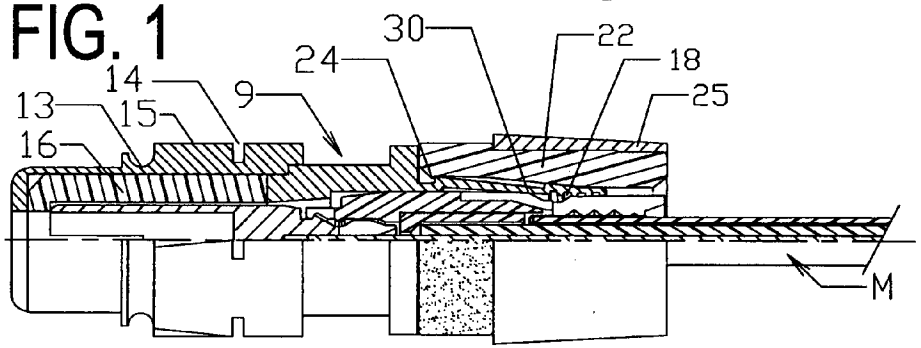
FIG. 3 is still another view of the assembly shown in FIGS. 1 and 2 after the connector body has been crimped onto the end of the cable.
Figure 4:
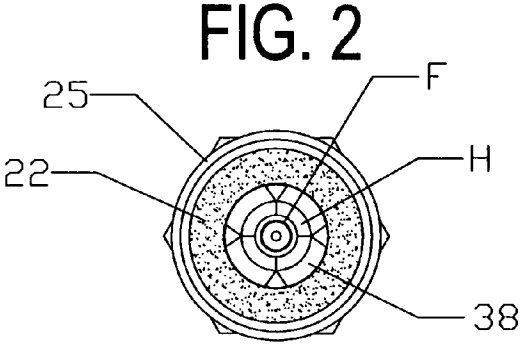
FIG. 4 is an end view of the assembly shown in FIG. 3.
Figure 5:
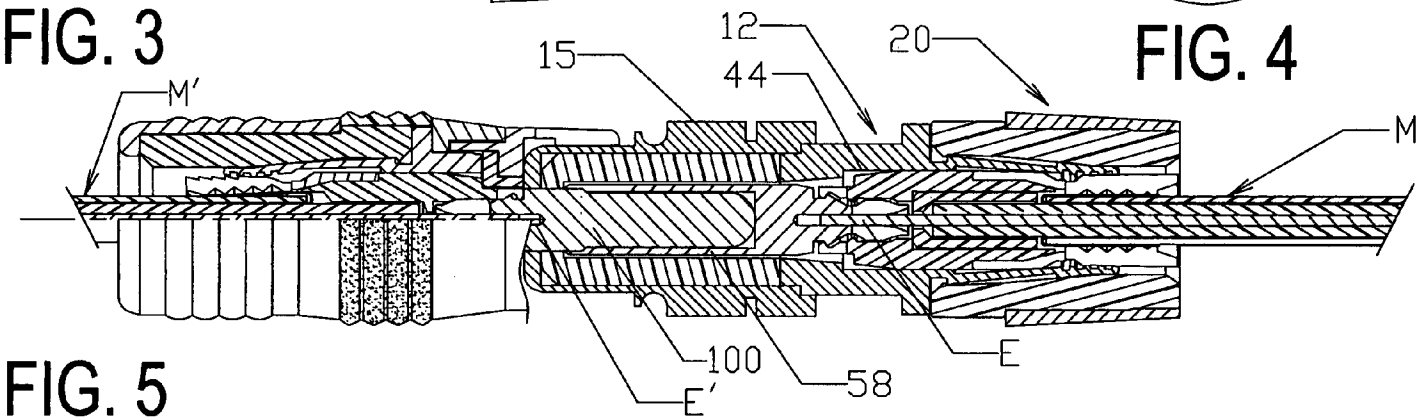
FIG. 5 is a longitudinal section view of a completed RCA splice connector assembly.
Figure 6:
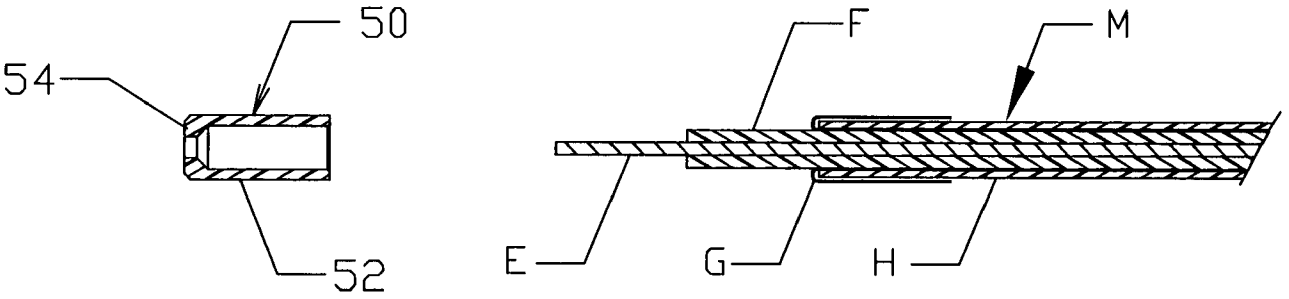
FIG. 6 is an exploded view of an extension tip for a mini-coaxial cable.

The assembled insert 30, as shown in FIGS. 5 and 9, is advanced through the hollow connector body 12 to center the second socket end portion 56 with respect to the inner sleeve 16, and the socket end portion 56 will continue to advance until the slotted hollow end 58 abuts the end wall of the sleeve 16 and the end retainer 44 is seated in the body 9.

It should be noted that the crimping ring 20 must be preassembled onto the end of the sleeve S2 before the insert assembly 30 and the connector body 12 are assembled as described. Thus, when the crimping ring 20 is advanced from the open position shown in FIG. 1 to the closed position shown in FIG. 2 will exert a radially inwardly directed crimping force on the sleeves S2 and S1 in succession which will force the arcuate segments 38 into positive uniform crimping engagement with the braided layer G and jacket H.

Again, the insert 30 reinforces the conductor E and facilitates blind insertion of the cable M into the connector body 12 and assures alignment of the doubled-over portion of the braided layer G and underlying jacket H with the internal teeth 41 along the metallic segments 38. Once the crimping ring 20 has been advanced to securely crimp the end of the cable M in position, the socket end portion 56 will act as a centering guide and extends through the sleeve 16 and terminates adjacent to the leading end of the barrel 10'.

Figure 13:
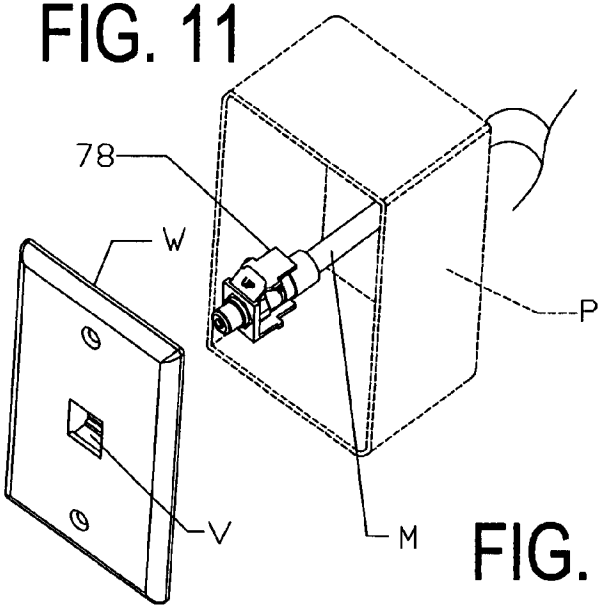
FIG. 13 is an exploded perspective view of the splice connector assembly of FIGS. 10 to 12 and illustrating the extension of a first cable through an outlet box.

FIGS. 10 to 13 illustrate the RCA socket connector 12 of FIGS. 1 to 9 and demonstrates its use or application in a wall mount assembly for an electrical outlet box P having a wall plate W, as shown in FIG. 13. To this end, a mounting clamp 78 has a square inner body 80 provided with a hexagonal opening 82 which is dimensioned to fit snugly over the hexagonal nut portion 15 of the connector body 12. The previously referred to band B is inserted into the slot 13 to designate the intended application, such as, a connection to a particular terminal on an electrical device, and the clamp 78 is mounted on the nut portion 15 so that the inner circumferentially spaced ribs 83 in the opening 82 are aligned with and inserted into the aligned slots 14 on the hexagonal nut portion 15.

Figure 21:
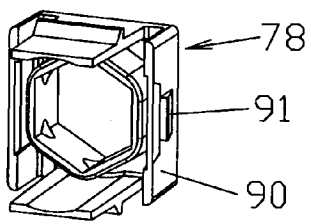
FIG. 21 is a rear perspective view of the clip shown in FIG. 20.
Figure 20:
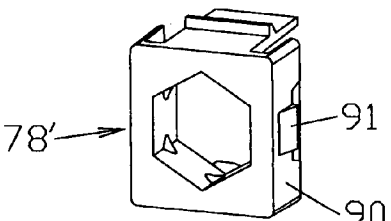
FIG. 20 is a front perspective view of another form of wall mount clip.

The clamp 78 shown in FIGS. 10-13, 18 and 19 is open-sided and includes a pair of upper and lower clamping plates or legs 84 and 85 spaced apart a distance just greater than the spacing between upper and lower edges of the opening V in wail plate W so that the plates 84 and 85 have to be pressed toward one another at their free ends to enable insertion into the wall plate W until shoulder portions 86 and 87 on the upper and lower plates 84 and 85 move into abutting relation to the wall plate W. It will be noted that the upper clamping plate 84 is joined to the body 80 by inclined connecting portion 88; however, the lower mounting plate 85 extends at right angles to the base of the body 80 so as to establish the proper spacing or distance between the plates 84 and 85 in relation to the size of the square opening V in the wall plate W. Further, locating tabs 68 are offset both laterally and downwardly from opposite sides of the upper plate and lower tabs 69 are laterally offset only from opposite sides of the lower plate 85 in order to cooperate with the shoulders 85, 86 in mounting the clamp 78 in the wall plate W. The modified form of clamp 78' shown in FIGS. 20 and 21 is identical to that of FIGS. 18 and 19 but additionally includes opposite sidewalls 90 with shoulders 91 to engage the sides of the wall plate opening V.

DETAILED DESCRIPTION OF ALTERNATE FORMS

Figure 14:
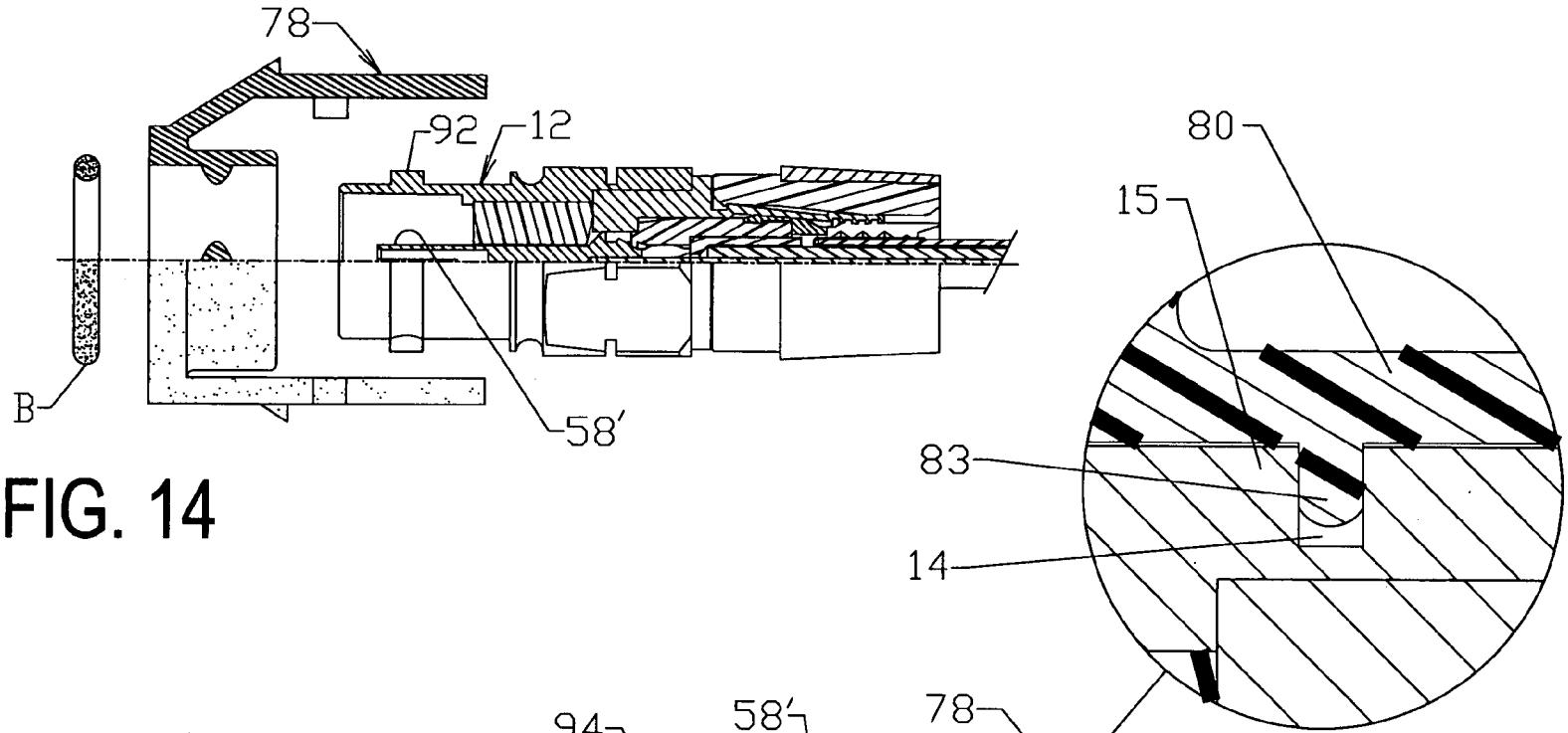
FIG. 14 is an exploded view partially in section of a BNC/RGB socket connector and wall mount clip and color band therefor.
Figure 15:
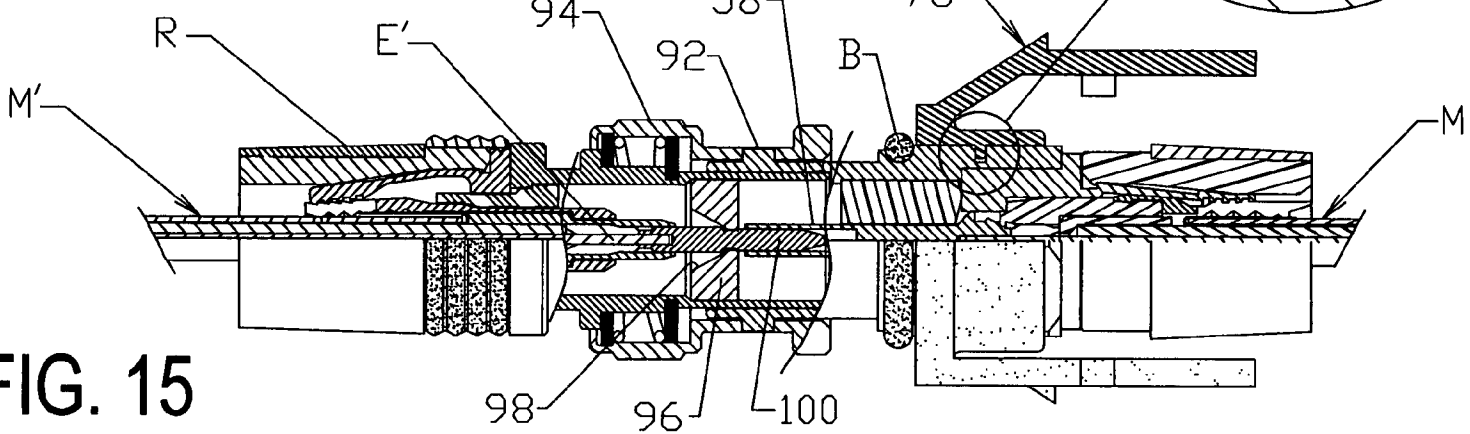
FIG. 15 is a view partially in section of the connector of FIG. 14 after assembly of the wall mount clip and connection of a second cable.

FIGS. 14 and 15 illustrate a BNC/RGB socket-end splice connector assembly for use with min-coaxial cables M and M' which substantially corresponds to the RCA connecter body 12 and accordingly like parts are correspondingly enumerated. The end wall 10' of the RCA connector is eliminated but an external flange 92 on the barrel facilitates connection of a standard BNC socket extension 94 on the end of the barrel with a bayonet slot which is slidable on the flange 92 in a conventional manner. Also, the extension 94 has an internal guide 96 with a tapered central opening 98 for insertion of the extension tip 100 of a pin conductor E' of the cable M'. For the purpose of illustration but not limitation the cable M' is mounted in a standard RGB connector, such as, Part No. FS RCA 1 RGB manufactured and sold by ICM Corp. Of Denver, Colo. Accordingly, the socket end 58' is reduced in diameter from that of FIGS. 1 to 9 for snug-fitting engagement with the extension tip 100 on the end of the pin E'.

Figure 16:
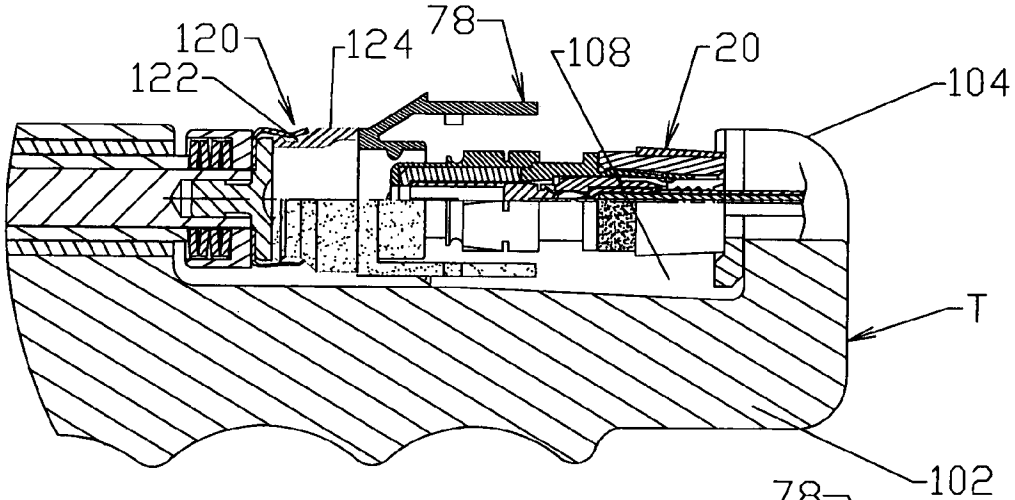
FIG. 16 is a sectional view of a tool for mounting of the wall mount clip onto the connector body.
Figure 17:
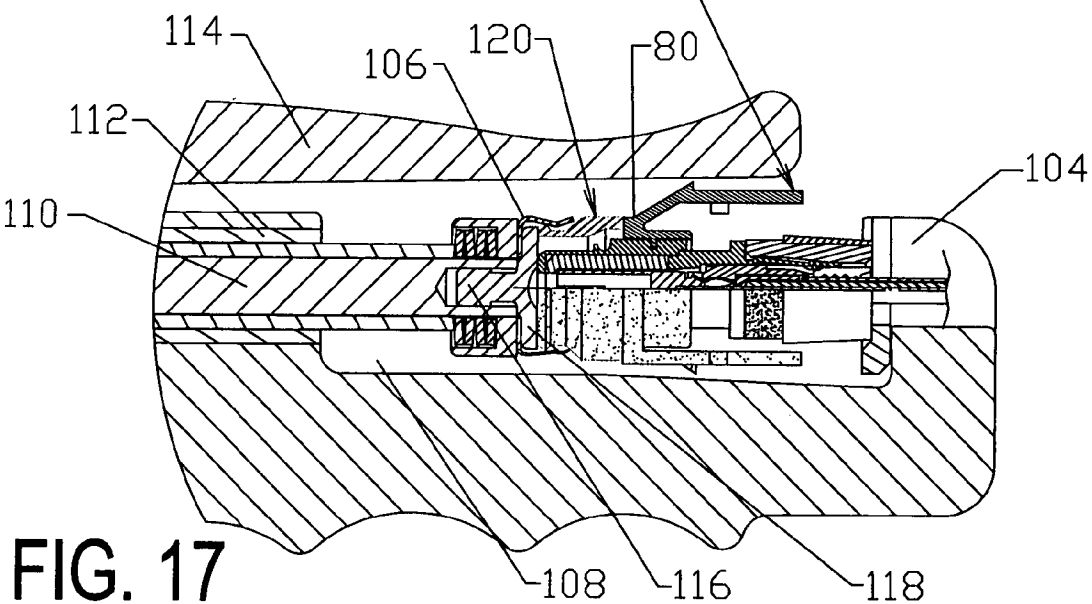
FIG. 17 is another sectional view of the tool of FIG. 15 in the closed position after mounting the clip on the connector body.
Figure 22:
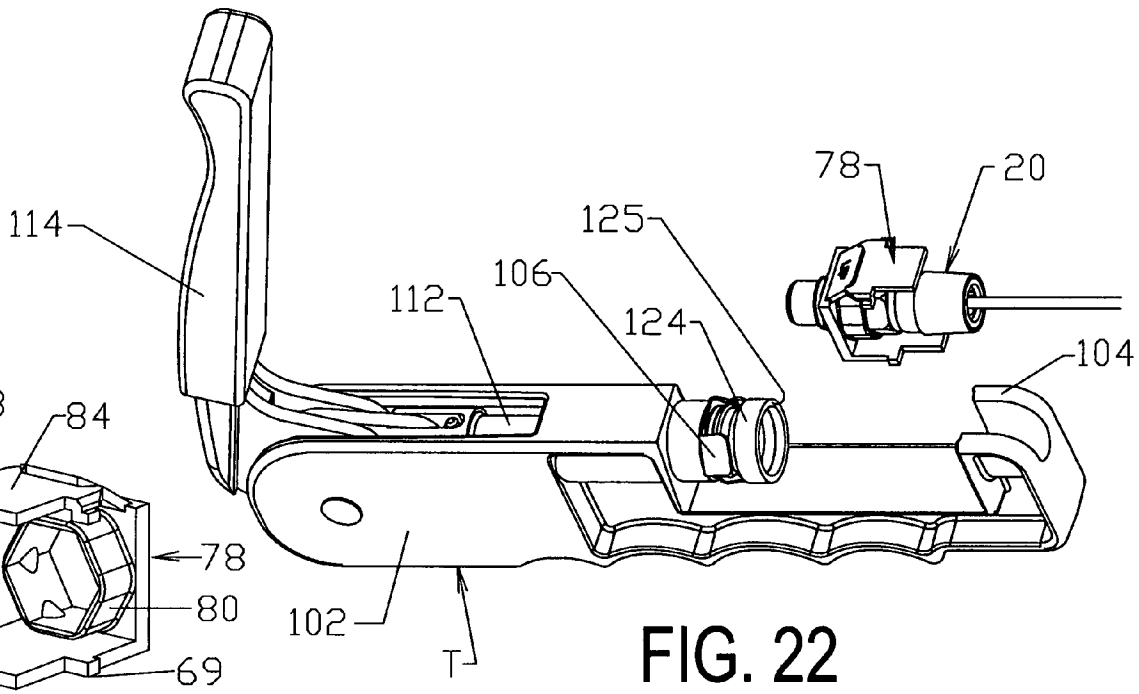
FIG. 22 is an exploded perspective view of the tool and connector body of FIGS. 16 and 17.
Figures 18, 19:
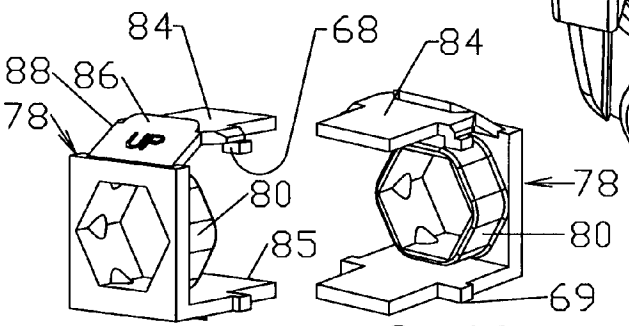
FIG. 18 is a front perspective view of one form of wall mount clip.
FIG. 19 is a rear perspective view of the clip shown in FIG. 18.

In use, the first cable M and its socket end 50 which are located in the electrical outlet box B are inserted into the connector body 12 and the crimping ring 20 is then advanced over the outer sleeves S1 and S2 to securely crimp the end of the cable M in position with the leading socket end portion 58 extending through the inner body or barrel portion 12 and terminating just short of the distal end of the barrel 12. The clamp 78 is mounted on the connector with a compression tool T, as shown in FIGS. 16, 17 and 22 and wherein the tool itself may be of the type set forth and described in U.S. Pat. No. 6,293,004 for LENGTHWISE COMPLIANT CRIMPING TOOL and U.S. Pat. No. 6,708,396 for UNIVERSAL CRIMPING TOOL, both assigned to the assignee of this patent application. Referring in particular to the U.S. Pat. No. 6,708,396, the tool is made up of an elongated body 102 having a yoke 104 at one end defining an end stop and in facing relation to a receiver 106 across a generally channel-shaped recess or opening 108 in the body 102. The receiver 106 is in the form of a spring clip having circumferentially spaced resilient tabs and is mounted on the plunger 110 which is axially advanced through bushing 112 by a lever arm 114. The receiver 106 is anchored to the end of the plunger by a shaft 116 having a base plate 118, and when the shaft is inserted into a bore at the end of the plunger 110 the receiver 106 is sandwiched between the base plate 118 and the end of the plunger 110.

Typically, the tool T is primarily intended for use with a plurality of different length tip extenders which can be releasably inserted into the receiver 106 for the purpose of engaging one end of a connector body and enable compression of a crimping ring onto the opposite end of the connector body into crimping engagement with a cable. For the purpose of mounting the clamp 78 onto the nut 15, in place of the tip extender, a hollow cylindrical attachment 120 has one end 122 of slightly reduced diameter and of external concave configuration which is complementary to the receiver tabs for releasable, snug-fitting insertion into the receiver 106, and a clip-engaging end 124 of increased outside diameter terminates in a circular rim 125 which is sized to engage the end surface 85 of the body 80. The body 80 is loosely mounted on the end of the connector body 12, as shown in FIG. 16, so as to bear against the rim 125. When the lever arm 114 is depressed from the open position shown in FIG. 16 to the closed position shown in FIG. 17, the fitting 120 will force the clamp 78 to slide in an axial direction over the nut 15 until the corner ribs 83 are aligned with the slots 14 in the nut 15. The lever arm 114 is then retracted and the connector body 10 along with the cable M is removed from the tool.

Preferring to FIG. 13, after clamp 78' is inserted into the opening V and the wall plate W is fastened to the electrical outlet box P, the color ring B is mounted in the external groove 13 so as to be visible externally of the wall plate after the installation has been completed. The cable M' which is mounted in a standard BNC/RGB connector R, such as, Part No. FS BNC 1 RGB is inserted into the end of the connector body 12 with the conductor pin E' and an extension tip 100 aligned for advancement into the socket end portion 58, as shown in FIG. 15. The socket end portion 58 is dimensioned to be slightly smaller than the extension tip 100 so that the slotted end 59 will undergo a slight expansion to receive the extension tip in snug-fitting relation and resist any tendency of the extension tip to accidentally escape from the socket end portion. The connection can be made in the same way as an RCA connector, for example, as illustrated in FIG. 5.

It is therefore to be understood that while different embodiments and aspects are herein set forth and described, the above and other modifications may be made therein without departing from the spirit and scope of the invention as defined by the appended claims and reasonable equivalents thereof. For example, virtually any type or size of coaxial cable connector may be attached in place of the cable M' into the min-coaxial cable splice connection assembly with or without the wall mount attachment.

We claim:

1. In a splice connector assembly for connecting male ends of a pair of cables to a hollow elongated connector body, the improvement comprising:

an adapter inserted into said body having a first elongated member of electrically conductive material including a recess at one end to receive an exposed inner conductor portion of one of said cables and a plurality of circumferentially spaced, open longitudinal slots in surrounding relation to said recess, and a second elongated member at an opposite end of said adapter having a socket end portion to receive an exposed inner conductor portion of the other of said cables in snug-fitting relation to said socket end portion; and means for compressing one end of said connector body and said first elongated member into engagement with said adapter and said one cable.

2. In an assembly according to claim 1 wherein said adapter includes a first sleeve of electrically non-conductive material engaging a dielectric portion of said one cable, and a second sleeve of electrically conductive material contacting said exposed inner conductor portion of said one cable.

3. In an assembly according to claim 2 wherein said second sleeve includes circumferentially spaced, open longitudinal slots provided with internal and external circumferentially extending teeth, said slots being dimensioned to be of a width to limit radial inward contraction of said second sleeve into clamping engagement with said one cable end.

4. In an assembly according to claim 1 including wall mounting means on said connector body for connecting said connector body to a wall plate over an electrical outlet box.

5. In an assembly according to claim 4 wherein said first cable is mounted in said box in connected relation to said connector body, and an opposite end of said connector body extends through an opening in said wall plate.

6. In an assembly according to claim 1 wherein an elastic color band is mounted on an external surface of said connector body.

7. In a splice connector assembly for connecting ends of a pair of cables to a hollow connector body wherein at least one cable is of the type having inner and outer concentric electrical conductors, an annular dielectric separating said conductors and an outer jacket of electrically non-conductive material, said inner and outer conductors having exposed portions and said inner conductor projecting beyond said dielectric at one end of said cable, the improvement comprising:

an insert mounted in said connector body for insertion of one of said cables therein, said insert including an adapter sleeve having a first portion of electrically non-conductive material to receive said dielectric and a second portion of electrically conductive material contacting said exposed portion of said outer conductor; and a crimping ring disposed at one end of said body.

8. In an assembly according to claim 7 wherein a first socket end portion is mounted on said dielectric and disposed in snug-fitting engagement with said adapter sleeve.

9. In an assembly according to claim 7 wherein said first portion is provided with circumferentially spaced longitudinal slots dimensioned to be of a width to limit inward radial contraction of said first portion to prevent crushing of said dielectric in response to axial advancement of said crimping ring over said one end of said body.

10. In an assembly according to claim 9 wherein said crimping ring has an inner tapered wall surface for compressing one end of said connector body and said adapter sleeve.

11. In an assembly according to claim 7 wherein said insert includes a second socket end portion at an opposite end thereof for insertion of an end of an inner conductor of a second cable therein.

12. In an assembly according to claim 11 wherein said socket end portion is slotted and of a diameter slightly less than said second cable inner conductor for snug-fitting engagement of said second cable inner conductor therein.

13. In a splice connector assembly for connecting a pair of coaxial cables to opposite ends of a hollow elongated connector body which is provided with a fastening member at one end for interchangeable connection to one of a plurality of electronic devices, each of said devices having a different application, said cables being of the type having inner and outer concentric electrical conductors, an annular dielectric separating said conductors and an outer jacket of electrically non-conductive material, the improvement comprising:

an adapter sleeve of electrically conductive material contacting an exposed portion of said outer conductor, and means for limiting inward radial deformation of said sleeve into engagement with said jacket while avoiding electrical contact with said outer conductor;

a crimping ring of a selected color representing the size of said cable for which said connector body is designed; and an external color band mounted in a groove on said connector body, said band being of a selected color to signify the intended application of said assembly to a particular use.

14. In an assembly according to claim 13 wherein said band is manually stretchable over said body and releasable to contract into close-fitting engagement with said body.

15. In an assembly according to claim 14 wherein said band has external, circumferentially extending ribs.

16. In an assembly according to claim 15 wherein said body includes an external groove dimensioned to receive said band.

17. In an assembly according to claim 13 wherein said band is stretchable over said body after assembly of said cable into said connector body.

18. In an assembly according to claim 13 wherein said assembly includes wall mounting means on said connector body for connecting said connector body to a wall plate over an electrical outlet box.

19. In an assembly according to claim 18 wherein said first cable is mounted in said box and is permanently connected by said crimping member to said connector body and an opposite end of said connector body extends through an opening in said wall plate.

20. In an assembly according to claim 13 wherein wall mounting means is provided for connecting said connector body to an electrical outlet box wherein said wall mounting means is in the form of a hollow frame having a generally hexagonal opening to receive said connector body with complementary ribs and slots between said opening and said connector body to establish locking engagement between said hollow frame and said connector body when said ribs and slots are moved into alignment with one another.

21. In an assembly according to claim 20 wherein said connector body and said opening have matching hexagonal surface portions and said complementary ribs and slots are disposed in intersecting edges of said surface portion.

22. In an assembly according to claim 20 wherein said frame is generally rectangular having opposed upper and lower spring-like plates and opposite side walls, and external stops on said plates and said side walls movable into abutting relation to said wall plate.

23. In an assembly according to claim 22 wherein said upper and lower plates have locator tabs on opposite sides thereof.

24. In an assembly according to claim 20 wherein said connector body has a first end disposed in said electrical outlet box for insertion of said one end of said cable and an opposite end to said first end protruding from said wall mounting means.

25. In a splice connector assembly having a connector body adapted for mounting in an electrical outlet box wherein said outlet box includes an external wall plate provided with an opening therein, means for connecting said connector body to said electrical outlet box including a clamp on said connector body having wall plate-engaging portions insertable into the opening in said wall plate wherein axially advancing said connector body and said clamp into said opening in said wall plate will force said wall plate-engaging portions into positive snap-fit engagement with surrounding edges of said opening in said wall plate.

26. In an assembly according to claim 25 wherein said wall plate has a generally hexagonal opening to receive said connector body and said clamp with complementary ribs and slots between said opening and said clamp to establish locking engagement between said wall plate and said connector body when said ribs and slots are moved into alignment with one another.

27. In an assembly according to claim 25 wherein said connector body and said opening have matching hexagonal surface portions and said complementary ribs and slots are disposed in intersecting edges of said surface portion.

28. In an assembly according to claim 25 wherein said clamp is generally rectangular having opposed upper arid lower spring-like plates and opposite side walls, and external stops on said plates and said side walls movable into abutting relation to said wall plate.

29. In an assembly according to claim 25 wherein said upper and lower spring-like plates have locator tabs on opposite sides thereof, and said connector body has a first end disposed in said electrical outlet box for insertion of said one end of said cable and an opposite end to said first end protruding from said wall mounting means.

* * * * *

UNITED STATES PATENT AND TRADEMARK OFFICE

CERTIFICATE OF CORRECTION

PATENT NO. : 7,326,079 B2
APPLICATION NO. : 11/408479
DATED : February 5, 2008
INVENTOR(S) : Randall A. Holliday and Robert M. Parker It is certified that error appears in the above-identified patent and that said Letters Patent is hereby corrected as shown below:

Title Page, Item (75) Inventors: should be corrected to delete "Ronald S. Munsterman"

| Column No. | Line No. | Correction |
|---|---|---|
| 5 | 41 | Cancel "wail plate" and substitute -- wall plate -- |
| 6 | 64 | Cancel "Preferring to" and substitute -- Referring to -- |
| 10 | 25 | Cancel "upper arid" and substitute -- upper and -- |

Signed and Sealed this

Twenty-sixth Day of August, 2008

JON W. DUDAS
*Director of the United States Patent and Trademark Office*